United States Patent [19]

Vida

[11] Patent Number: 4,626,743

[45] Date of Patent: Dec. 2, 1986

[54] HIGH-PRESSURE SODIUM LAMP

[75] Inventor: Dénes Vida, Budapest, Hungary

[73] Assignee: Egyesült Izzólèmpa òs Villamossàgi Rt., Budapest, Hungary

[21] Appl. No.: 469,065

[22] Filed: Feb. 23, 1983

[51] Int. Cl.[4] ..... H01J 17/20; H01J 61/20

[52] U.S. Cl. ..... 313/571; 313/642

[58] Field of Search ..... 313/571, 638, 639, 642

[56] References Cited

U.S. PATENT DOCUMENTS

| | | | |
|---|---|---|---|
| 3,521,108 | 7/1970 | Hanneman | 313/571 |
| 3,898,504 | 8/1975 | Akutsu et al. | 313/639 X |
| 4,075,530 | 2/1978 | Furukubo et al. | 313/639 X |
| 4,341,978 | 7/1982 | Thornton, Jr. et al. | 313/639 X |

*Primary Examiner*—Palmer C. DeMeo

*Assistant Examiner*—Sandra L. O'Shea

*Attorney, Agent, or Firm*—Gabriel P. Katona

[57] ABSTRACT

A high-pressure sodium vapor lamp, comprising a hermetically closed tube made of a translucent material of high thermal resistivity as alumina, at least two electrodes arranged in the tube, is filled with noble gas particularly xenon and with vapors of sodium and mercury and/or cadmium under pressure of saturated vapors at the temperature of operating. The quantity of the vapors of mercury and/or cadmium is in the range from 0.5 to 5.0 micromol for each centimeter of length of the discharge arc initiated between the electrodes. The high-pressure sodium lamp with the mentioned quantity of additives is assured a long lifetime of operation.

1 Claim, 2 Drawing Figures

HIGH-PRESSURE SODIUM LAMP

FIELD AND BACKGROUND OF THE INVENTION

The present invention relates to a high-pressure sodium vapour lamp, comprising a hermetically closed tube made of translucent material of high thermal resistivity, particularly of ceramics, at least two electrodes arranged in said tube for initiating a discharge arc, and a filling containing noble gas, particularly xenon and metal additives as sodium and mercury and/or cadmium, wherein the metal additives are present in a quantity as to ensure pressure of saturated vapour at the temperature of operating of the lamp.

In the high-pressure sodium vapour lamps the discharge is usually initiated in a tube made of translucent material, for example, ceramics, such as alumina of high thermal resistivity. This tube is usually arranged in an outer vessel including also the electric input means of the tube. The outer vessel is evacuated to vacuum. The current is supplied to the electrodes arranged in the tube, on the two ends thereof by means of electric inlets made of niobium or of metallized ceramics closing elements or of metallic ceramics. The tube comprises a filling containing noble gas (or some noble gases) and metal additives. Noble gas is important for initiating the arc discharge and for this purpose xenon seems to be the most advantageous. As metal additives sodium and mercury and/or cadmium should be used. The character of the discharge is determined mainly by the sodium which is present in a working lamp under pressure of about 0.1 to 1.0 bar range, while the other metal additives are intended to adjust the electric parameters of the lamp.

During operation the high-pressure sodium vapour lamp is gradually losing its sodium content. Therefore the quantity of metal additives is chosen to be so high that decreasing quantity of sodium do not cause higher change in the composition of the fluid phase of the metal additives. For this purpose a high quantity of the metal additives is required and, in this case, the quantity of the metal additives being present in fluid phase is many times higher than that of the metal additives being present in vapour phase. A sodium vapour lamp based on this principle is shown in U.S. Pat. No. 3,384,798. The common disadvantage of the high-pressure sodium vapour lamp described in that patent or one of similar construction is that decreasing quantity of sodium and gradual blackening of the ends of the ceramic tube result in increasing burning or operating voltage of the sodium lamp. The operating voltage can reach such a high value at which the oscillation of the supply voltage will result in extinction of the lamp. In order to prevent this extinction after a possible long life time, the sodium vapour lamps are usually adjusted to be operated at relatively low supply voltage, which causes the disadvantage that at the beginning period of the use of the high-pressure vapour sodium lamps can not take up the nominal power and therefore they can not give the desired light output.

Another solution is described in U.S. Pat. No 4,075,530, according to which the high-pressure sodium vapour lamp is filled with nonsaturated vapour, which means that during the operation of the lamp the entire quantity of sodium and mercury is in vapour phase. In the lamps built up according to this solution, however, the operating voltage of the sodium vapour lamp is not changing when supply voltage is changing, but a low quantity of metal additives is filled in therefore the sodium is quickly decreases, which leads to the fact that the lamps originally intended to operate as a sodium vapour lamp, will operate as a mercury lamp.

SUMMARY OF THE INVENTION

The object of the present invention is to provide a solution according to which the high-pressure sodium vapour lamp operates as long as possible as a sodium vapour lamp and, during its life time the operating voltage of the lamp will remain at a relatively stable level, and it does not reach the value of extinction.

The invention is based on the recognition that most desirable results can be attained, which is surprising, if sodium is present in a quantity according to known solutions required for ensuring the pressure necessary for saturated vapor at the operating temperature while the quantity of mercury and/or cadmium is chosen in an appropriate quantity.

On the basis of the recognition presented above, a high-pressure sodium-vapour lamp has been provided, comprising a hermetically closed tube made of translucent material of high thermal resistivity, particularly of ceramics, at least two electrodes arranged in the tube for initiating a discharge arc, and a filling containing noble gas, particularly xenon and metal additives as sodium and mercury and/or cadmium, wherein the metal additives are present in a quantity as to ensure pressure of saturated vapour at the temperature of operating of the lamp, wherein according to the invention the quantity of mercury and/or cadmium is selected in the range of 0.5 to 5.0 micromol for each centimeter of length of the discharge arc.

It is advantageous to chose the quantity of mercury and/or cadmium in the range of 0.5 to 2.5 micromol for each centimeter of the discharge arc, because in this value range the desired effect appears in more explicit manner.

It has been found that if the quantity of mercury and/or cadmium is maintained in the concentration range according to the invention self-regulating conditions of maintaining the operating voltage of the high-pressure sodium vapour lamp are ensured.

BRIEF DESCRIPTION OF THE DRAWINGS

For explanation of this fact and for illustrating an advantageous embodiment reference will be made to the acompanying drawing, wherein.

DESCRIPTION OF THE PREFERRED EMBODIMENTS

Figure 1:
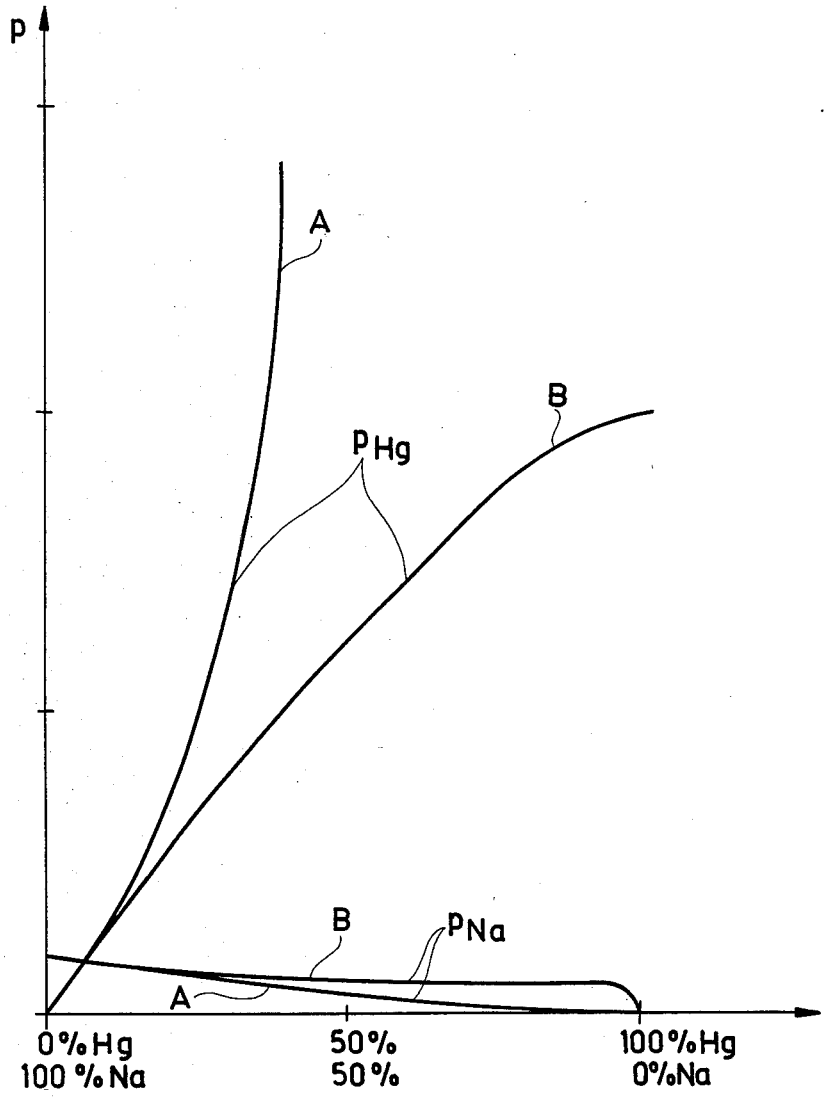
FIG. 1 shows the curves vapour pressure p (in bars) of mercury and sodium as function of mol% of mercury or rather sodium content of the tube at stable temperature of the cold point of the tube and FIG. 2 is a cross-section of a lighting unit comprising a high-pressure sodium vapour lamp according to the invention.

By curves A FIG. 1 shows the usual functions of the lamps filled with saturated vapour, wherein the main part of the metal additives in form of mercury and sodium is present as fluid and only a very small part thereof is in vapour form in the interior of the lamp. It can be seen that when the quantity of sodium is decreasing (according to the mechanism mentioned above) vapour pressure $p_{Hg}$ of mercury is increasing very quickly and vapour pressure $p_{Na}$ of sodium is decreasing. At a relatively high concentration value of sodium it is the situation that vapour pressure $p_{Hg}$ of mercury causes increasing operating voltage and thereby extinction of the lamp.

Another situation can be observed in case of the curves labeled B, according to which the quantity of mercury and/or cadmium is limited as proposed in the present invention. When choosing the quantity of mercury in the tube in order to ensure a operating voltage value for maintaining the operating voltage higher than the voltage of extinction, curves A go over into curves B. It can be seen, that when the composition of the additives in filling changes, the vapour pressure $p_{Hg}$ of mercury alters in a narrow value range and it can be reached that in the most disadvantageous case—i.e. in the case of higher operating voltage—the sodium vapour lamp remains ready for operating. At the same time it can be seen that altering concentration causes a very small change of the vapour pressure $p_{Na}$ of sodium.

Similarly to the use of mercury with sodium it is possible to put into the lamp cadmium and if necessary also mercury in a low quantity that assures the above mentioned stabilising effect.

Figure 2:
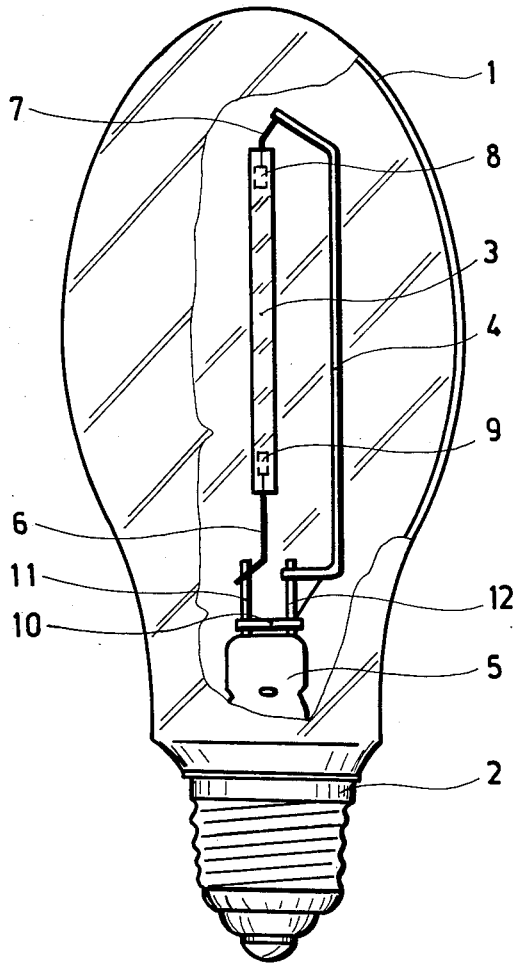

An advantageous embodiment of the high-pressure sodium vapour lamps according to the invention can be realised on the basis of the FIG. 2 showing a cross section of a lighting unit comprising a high-pressure sodium vapour lamp. The lighting unit is disposed in a vessel 1 evacuated, wherein an alumina tube 3 is arranged. The tube 3 belonging to the high-pressure sodium vapour lamp comprises a base 2, input wires 6 and 7. The input wires 6 and 7 are made of niobium. They are welded to an input terminal 11 on a carriage 5 and connected over a frame 4 to an other input terminal 12. The input wires 6 and 7 are connected to electrodes 8 and 9 covered by an emitting material. The electrodes 8 and 9 are arranged in the interior of the tube 3. The input wires 6 and 7 are hermetically sealed in base sections 2. The tube 3 contains a filling including at least one kind of noble gas, particularly xenon for initiating a discharge arc between the electrodes 8 and 9. This filling includes also metal additives as sodium and mercury and/or cadmium. Purity of vacuum in the vessel 1 is ensured by a getter 10.

An example of selecting the metal additives for a high-pressure sodium vapour lamp according to the above disclosure is the following:

Into a tube 3 made of alumina with an inner diameter 6.9 mm, a volume 3.3 $cm^3$ and a distance 7.5 cm between the electrodes, there are introduced additives as follows: 17 micromol of mercury and 43 micromol of sodium and as initiating gas xenon to pressure of 26 mbar range. The light output of the high-pressure sodium vapour lamp is 100 lm/W at a power consumption of 250 W, the colour restoration index is Ra=32. When contacting the lamp to a supply unit for a long operation, the quantity of sodium is decreasing but this fact does not cause a extinction of the lamp. When introducing 240 micromol sodium and mercury into the lamp, as usual, the high pressure sodium vapour lamps show tendency to become extinguished.

In an other embodiment realized purely by way of example the tube 3 contains 10 micromol mercury and 43 micromol sodium. The quantity of xenon is enough to ensure pressure of 80 mbar range. The light input of the sodium vapour lamp of 300 W power is 80 lm/W and its colour restauration index is Ra=72. This lamp shows also no tendency to become extinguished. As experience shows the other high-pressure sodium vapour lamps with lower power value behave in a similar manner.

The advantage of the lamps according to the invention is that they behave during a longer time period than the known lamps as a sodium vapour lamp and that a stable value of the operating voltage is ensured during the lifetime of the lamps showing no tendency to become extinguished.

The high-pressure sodium vapour lamp according to the present invention can be advantageously used in different lighting units.

From the above description it should be understood that high-pressure sodium vapour lamps equivalent to those given above will be within the scope of protection defined by the claims.

I claim:

1. A high pressure sodium vapor lamp comprising a hermetically closed tube made of translucent ceramic material of high thermal resistivity, at least two electrodes arranged in said tube for initiating a discharge arc, and a filling in said tube, wherein said filling comprises xenon, sodium in a quantity as to ensure pressure of saturated vapor at operating temperature, and mercury in a quantity of 0.5 to 2.5 micromol for each centimeter of length of the discharge arc.

* * * * *